US011053784B2

(12) United States Patent
Michel

(10) Patent No.: US 11,053,784 B2
(45) Date of Patent: Jul. 6, 2021

(54) DOWNHOLE PUMP WITH TRAVELING VALVE AND PILOT

(71) Applicant: VLP LIFT SYSTEMS, LLC, Richmond, TX (US)

(72) Inventor: William Michel, Etival Clairfontaine (FR)

(73) Assignee: VLP LIFT SYSTEMS, LLC, Richmond, TX (US)

( * ) Notice: Subject to any disclaimer, the term of this patent is extended or adjusted under 35 U.S.C. 154(b) by 296 days.

(21) Appl. No.: 15/959,642

(22) Filed: Apr. 23, 2018

(65) Prior Publication Data

US 2018/0340402 A1 Nov. 29, 2018

Related U.S. Application Data

(63) Continuation-in-part of application No. 15/262,313, filed on Sep. 12, 2016, now Pat. No. 10,364,658.
(Continued)

(51) Int. Cl.

| | |
|---|---|
| ***E21B 43/12*** | (2006.01) |
| ***F04B 53/12*** | (2006.01) |
| ***F04B 39/10*** | (2006.01) |
| ***F04B 53/14*** | (2006.01) |
| ***F04B 39/00*** | (2006.01) |

(52) U.S. Cl.
CPC ..... *E21B 43/127* (2013.01); *F04B 39/1013* (2013.01); *F04B 53/125* (2013.01); *F04B 53/14* (2013.01); *F04B 39/0016* (2013.01)

(58) Field of Classification Search
CPC ..... F04B 47/02; F04B 53/12; F04B 53/125; F04B 53/129; F04B 39/0016; F04B 39/01013; F04B 53/14; F16K 15/026; F16K 15/021; F16K 15/063
See application file for complete search history.

(56) References Cited

U.S. PATENT DOCUMENTS 3,479,958 A * 11/1969 Anderson ..... F04B 47/00 417/437
3,861,471 A 1/1975 Douglas
(Continued)

FOREIGN PATENT DOCUMENTS

WO 2015122990 A1 8/2015
WO 2016205131 A1 6/2016

OTHER PUBLICATIONS

International Search Report and Written Opinion of the ISA for PCT/US2019/022916.

*Primary Examiner* — Bryan M Lettman

(57) ABSTRACT

A fluid pump apparatus for an artificial lift system has a barrel, a standing valve positioned at a lower end of the barrel so as to be movable between an open position and a closed position, a plunger reciprocatingly mounted in the barrel, a traveling valve positioned in an interior of the plunger so as to control fluid flow through the plunger, and a pilot slidably positioned in the plunger. The plunger has a first aperture at an upper portion thereof and a second aperture extending through a wall of the plunger so as to open to a channel extending through the channel. The traveling valve is slidably movable within an interior of the plunger. The plunger has a seat that is cooperative with a surface of the traveling valve. The pilot is cooperative at the surface of the traveling valve so as to move the traveling valve.

12 Claims, 8 Drawing Sheets

Related U.S. Application Data

(60) Provisional application No. 62/218,087, filed on Sep. 14, 2015.

(56) References Cited

U.S. PATENT DOCUMENTS

| | | | | |
|---|---|---|---|---|
| 4,490,095 | A | 12/1984 | Soderberg | |
| 4,565,246 | A * | 1/1986 | Frazier | F04B 53/126 166/112 |
| 4,867,242 | A * | 9/1989 | Hart | E21B 34/06 166/369 |
| 4,913,630 | A | 4/1990 | Cotherman et al. | |
| 5,040,608 | A | 8/1991 | Doan | |
| 5,139,398 | A | 8/1992 | Downing | |
| 2005/0053503 | A1 | 3/2005 | Gallant | |
| 2005/0226752 | A1 | 10/2005 | Brown | |
| 2009/0000789 | A1 | 1/2009 | Leuthen et al. | |
| 2015/0017036 | A1* | 1/2015 | Krilow | E21B 43/127 417/443 |
| 2015/0107823 | A1 | 4/2015 | Gronning | |

* cited by examiner

DOWNHOLE PUMP WITH TRAVELING VALVE AND PILOT

CROSS-REFERENCE TO RELATED APPLICATIONS

The present application is a continuation-in-part of U.S. patent application Ser. No. 15/262,313, filed on Sep. 12, 2016, and entitled "Downhole Pump with Controlled Traveling Valve", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to downhole pumps. More particularly, the present invention relates to rod-type pumps in which a plunger is used so as to draw fluids through a standing valve and pass the fluids through a traveling valve so as to form a fluid column within the production tubing. More particularly, the present invention relates to downhole pumps in which the traveling valve is controlled during the movement of the plunger so as to facilitate the equalization of pressures within the production tubing while, at the same time, effectively removing sand accumulations from within the production tubing, within the barrel, and within the plunger

2. Description of Related Art Including Information Disclosed Under 37 CFR 1.97 And 37 CFR 1.98

Artificial lift refers to the use of an artificial means to increase the flow of fluids, such as crude oil, gas or water, from a production well. Generally, this is achieved by the use of a mechanical device inside the well (known as a pump) or by decreasing the weight of the hydrostatic column by injecting gas into the liquid some distance down the well. Artificial lift is needed in wells when there is insufficient pressure in the reservoir to lift the produced fluids to the surface, but often is used in naturally flowing wells to increase the flow rate above what would flow naturally. The produced fluid can be oil, water, or a mix of oil and water, along with produced fluids having some amount of gas.

Conventional oil and gas wells include a cased wellbore with a tubing string extending down to the hydrocarbon bearing formation. The casing is perforated at the production level to permit the hydrocarbons to flow into the casing and the bottom of the tubing is generally open to permit the hydrocarbons to flow into the tubing and up to the surface. Oftentimes, there is insufficient pressure in a formation to cause oil, other liquids and gases to readily flow to the surface. It therefore becomes necessary to install the artificial lift system so as to pump the fluids to the surface.

One of the most common types of artificial lift systems is a rod pump. This type of pump is positioned in the well at the level of the fluids to be removed and is mechanically driven by a series of rods connecting the pump to a pumping unit at the surface. These rod pumps include the simple combination of a cylinder or barrel with a piston or plunger and a suitable intake valve and a discharge valve. The intake valve is often referred to as a "standing valve" and the discharge valve is often referred to as a "traveling valve".

Two of the more common types of rod pumps are the tubing pump in which the pump barrel is attached directly to the tubing and is lowered to the bottom of the well as the tubing is run into the well. The plunger is attached to the bottom of the sucker rod that is positioned within the pump barrel. The intake valve is positioned at the bottom of the pump barrel and the traveling valve is positioned on the plunger. The second type of pump is often referred to as an insert pump and the entire assembly is attached to the bottom of the sucker rod. The barrel is held in place by a special seating nipple or other device positioned within the tubing. This type of pump has the advantage that it can more easily be removed for repair or replacement than a tubing pump.

The operation of a rod pump is relatively simple. The plunger reciprocates up-and-down in the barrel under the force of the sucker rod. During the upstroke, the traveling valve is closed and the fluid above the plunger is lifted to the surface by the plunger and the sucker rod. At the same time, the standing valve is open so as to allow fluids to flow into and fill the now-evacuated barrel. On the downstroke, the standing valve is closed so as to trap the fluids in the barrel. The traveling valve is opened allowing the compressed fluids to flow through the plunger so that they can be lifted during the subsequent cycle.

While rod pumps have been in use for decades and have proven to be economical and reliable, they still experience certain shortcomings and problems. Some of these problems are associated with valves which are generally of the ball-and-seat variety. This type of valve is opened and closed by pressure differentials across the valve.

A most serious problem that arises in the operation of such rod pumps and most other oil well pumps involves the phenomenon of fluid hammer. Another problem associated with fluid hammer is that of gas lock in the pump. Both of these problems result in inefficient operation, accelerated deterioration of the pump assembly, and very expensive intervention efforts.

These problems occur frequently when the well is producing fluid hydrocarbons having compressed or dissolved gas therein. During the suction stroke of the pump assembly, the gas comes out of solution and expands due to the low pressure of the fluid inside the pump. This expanded gas displaces fluid in the pump and reduces the amount of fluid pump per cycle of pump operation. It often even reaches the point where no fluid is lifted by the pump because the pump merely operates on a charge of gas, alternately compressing and expanding it, and a pump efficiency consequently drops to zero. This is due to the fact that with a large volume of relatively compressible gas, the pressure between the standing valve and the traveling valve on the pump downstroke never reaches a high enough level to overcome the hydrostatic pressure of the fluid on top of the traveling valve to open the traveling valve and pump the gas upward out of the pump assembly.

Fluid pound occurs in a reciprocating oil well pump when, on the downstroke of the plunger, there is a large pocket of gas in the barrel instead of the normal well fluids and the gas offers little resistance to the downward movement of the plunger and sucker string. This results in a swift downward movement of the plunger and a resulting hard impact when it reaches the top of the fluid level in the barrel. This impact is very destructive on the tool parts and greatly reduces the life and efficiency of the pumping apparatus. The impact can also cause a buckling of the rod.

During the production of the formation fluid, mineral particles, often referred to as sand, may be swept into the flow path. The sand may erode production components, such as the downhole pump or sucker rod pump, the control valves on the surface, the ball-and-seat arrangement of the standing valve, etc. in the flow path. When substantial quantities of sand are carried along as oil and/or gas is removed from a formation, the sand can eventually plug the openings in the interior of the tubing by which the hydrocarbon production is withdrawn to the earth's surface. It is not uncommon for the pump itself to stick and/or the barrel to stick as a result of sand or other particulate matter becoming caught between the barrel and the plunger. The tolerances between the barrel and the plunger are close so as to effect a seal between the plunger and the barrel. If sand lodges therebetween, either the plunger or the barrel will be reduced or the plunger sticks in the barrel. The structure of such pumps makes them particularly prone to such damage because such pumps rely on a seal which is formed between the plunger and barrel by the leading edge of the plunger.

Generally, when the pump becomes "sanded in" in the production tubing, a very complicated procedure is required so as to remove the sanded-in components of the well. Typically, the production tubing would have to be removed so as to separate the pump from the tubing and remove the sand accumulation. As such, is important that sand be removed from the interior of the production tubing and from the interior of the barrel so as to prevent these problems from occurring.

Typically, such rod pumps do not operate at very well in association with multi-phase fluids or with gas wells. In multi-phase fluids, there can be a gas and a liquid, such as oil or water. In gas wells, typically, the multi-phase liquid will include gas, water and light oil. Because of the high percentage of gas in such wells, the problems associated with gas locks and/or fluid pounding occur more frequently.

Currently, there is a strong trend toward horizontal or deviated wells. Such rod pumps are not particularly effective in pumping the fluid in such deviated or horizontal wells. This is because the sucker rod will have to travel in a similar pattern to that of the deviated wells. In certain circumstances, the deviated well can have a convoluted or S-shaped configuration. As such, it is very difficult for the rod to effectively reciprocate upwardly and downwardly in such deviated wells. Furthermore, when sucker rods are used in such deviated wells, they can rub against the side of the production tubing so as to eventually perforate the production tubing in areas that are not desired. The frictional contact between the rod and the inner wall of the production tubing can further potentially damage the sucker rod such that the well will need to be repaired by pulling the production tubing and replacing the damaged tubing or by pulling the sucker rod and replacing the damaged section of the sucker rod. Once again, this could lead to an extended period of non-productivity of the well.

In the past, various patents have issued for pumping systems that attempt to address the problem of gas lock. For example, U.S. Pat. No. 3,861,471, issued on Jan. 21, 1975 to B. L. Douglas, describes an oil well pump having a gas lock prevention means and method of use thereof. An oil well pump is disclosed which features gas lock and fluid hammer prevention mechanisms which utilize a tubular plunger having relief ports and check valves therein. The plunger is telescopically located in a tubular barrel pump having check valves and relief passages therein.

U.S. Pat. No. 4,490,095, issued on Dec. 25, 1984 to P. V. Soderberg, teaches an oil well pump system for pumping liquid from a well such that the vapor lock of the pump cannot occur due to the gas or steam and such that the pump strokes only in response the production rate of well liquid. The pump is used for lifting heavy oils heated by steam floods or the like as well as pumping liquids from conventional wells.

U.S. Pat. No. 4,867,242, issued on Dec. 19, 1989 to G. E. Hert, shows a method and apparatus for breaking a gas lock in an oil well pump. This gas lock breaker includes a stationary barrel with a standing valve on the bottom, a reciprocating piston in the barrel with a traveling valve on the bottom of the piston, and unseating rod positioned above the traveling valve and adapted to protrude into the traveling valve to unseat the ball closure thereof near the bottom extremity of the downstroke of the piston.

U.S. Pat. No. 4,913,630, issued on Apr. 3, 1990 to Cotherman et al., provides a submersible pump system and method for producing oil from gassy wells. First and second stage gas separators protect a submersible pump from a vapor lock. The pump communicates with the production tubing and is driven by a shaft extending from a motor, through the first and second stage gas separators. The first stage gas separator has a first stage inlet through the housing in communication with the production fluid from the producing formation. The second stage gas separator has a second stage inlet communicating with the first stage liquid outlet and leads to a secondary means of separating the gas from the production fluids. The separated gaseous components are expelled through the housing and into the annulus at a second stage gas outlet while retained liquid components of the production fluid are presented to the pump or to additional separation stages through the second stage outlet.

U.S. Patent Application Publication No. 2005/0053503, published on Mar. 10, 2005 to R. D. Gallant, shows an anti-gas lock pumping system in which the pump is designed and such that any gas present in the fluid being pumped is completely displaced from the pumping chamber with each downstroke of a pump plunger.

U.S. Patent Application Publication No. 2005/0226752, published on Oct. 13, 2005 to T. L. Brown, provides an apparatus and method for reducing gas lock in downhole pumps. The pump has a barrel with vent ports located therein and a plunger that reciprocates inside the barrel. The barrel has a standing valve and the plunger has a traveling valve. The plunger has a first position with a seal between the plunger and the barrel and a second position with a clearance between the plunger and the barrel. On the downstroke, gas contained in the compression chamber between the two valves vents through the clearance and out of the barrel through the vent port into the wellbore. When the plunger contacts liquid in the compression chamber, the liquid enters the clearance and forms a seal, wherein the plunger traveling valve opens.

U.S. Patent Application Publication No. 2009/0000789, published on Jan. 1, 2009 to Leuthen et al., discloses a device, method and product for detecting and breaking up an occurrence of a gas lock in an electrical submersible pump assembly in a wellbore. This is based upon surface or downhole data. The system provides the ability to flush the pump and return the system back to production without requiring system shutdown. The system provides an algorithm for controlling a pump operating speed of the electrical submersible pump assembly to maximize production from the wellbore.

U.S. Patent Application Publication No. 2015/0233370, published on Oct. 20, 2015 to the Bebak et al., teaches a magnetic anti-gas lock rod pump. The well pump has a standing valve seat and a standing valve mounted in a lower end of the barrel. A plunger is carried within the barrel for axial stroking movement. A traveling seat with a traveling valve is mounted in a lower end of the plunger. The traveling valve has a head that lands on the traveling valve seat while the traveling valve is in a closed position. The traveling valve has a stem extending downwardly from the head through a hole in the traveling seat. The stem is a permanent magnet. Another permanent magnet is carried by the barrel below the traveling magnet. The polarities of the magnets are configured to interact and cause the traveling valve to lift relative to the traveling seat to an open position as the plunger nears a bottom of the stroke.

International Publication No. WO2016205131, published on Dec. 22, 2016 to Brown et al., discloses a positive displacement plunger pump with a gas escape valve. The well pump assembly has a barrel, a standing valve at an upper end of a standing valve chamber, and a plunger. The traveling valve admits well fluid into the barrel during a fill stroke. The traveling valve closes during a power stroke so that the plunger pushes well fluid from the barrel into the standing valve chamber. A gas release port extends from the standing valve chamber to the exterior of the pump assembly. A check valve in the gas release port has an outward flow blocking position for blocking liquid well fluid in the standing valve chamber from exiting through the gas release port while the plunger is in the power stroke. A check valve has a gas release position that enables gas present in the standing valve chamber to flow out of the gas release port while the plunger is in the power stroke.

It is an object of the present invention to provide a downhole pump system that has greater operational capabilities.

It is another object of the present invention to provide a downhole pump system that has lower operating costs.

It is still another object of the present invention to provide a downhole pump system that maximizes hydrocarbon production.

It is another object of the present invention to provide a downhole pump system that avoids gas locks.

It is a further object of the present invention to provide a downhole pump system that operates in horizontal and/or highly-deviated production tubing.

It is another object of the present invention to provide a downhole pump system that is able to able to produce at low rates and at high pressures.

It is another object of the present invention to provide a downhole pump system that is operable at extended depths and high temperatures.

It is still another object of the present invention to provide a downhole pump system that effectively removes solids from the fluid during the production.

It is another object of the present invention provide a downhole pump system that provides extended runtime.

It is still a further object of the present invention to provide a downhole pump system that has reduced sensitivity to solids plugging.

It is another object of the present invention to provide a downhole pump system that reduces rod buckling stress and reduces the problems associated with deviated rods.

It is still another object of the present invention to provide a downhole pump system that maximizes pump fillage.

It is still another object of the present invention provide a downhole pump system that avoids ball dance damage.

It is still a further object of the present invention to provide a downhole pump system that minimizes fluid pound and the problems resulting from fluid pound.

These and other objects and advantages of the present invention will become apparent from a reading of the attached specification and appended claims.

BRIEF SUMMARY OF THE INVENTION

The present invention is a fluid pump apparatus for an artificial lift system. The fluid pump apparatus includes a barrel having an upper end and a lower end, a standing valve positioned at the lower end of the barrel and movable between an open position and a closed position, a plunger reciprocatingly mounted in the barrel, a traveling valve positioned in an interior of the plunger so as to control fluid flow through the plunger, and a pilot slidably positioned in the plunger. The plunger has a first aperture at an upper portion thereof and a second aperture extending through a wall of the plunger so as to open to a channel extending longitudinally through the plunger. The traveling valve is slidably mounted within an interior of the plunger. The plunger has a seat that is cooperative with the surface of the traveling valve. The pilot is cooperative with the surface of the traveling valve so as to move the traveling valve relative to the seat. The pilot has an end that separable from the traveling valve during the reciprocating movement of the plunger.

The barrel of the fluid pump apparatus of the present invention has a first wide inner diameter section, a second wide inner diameter section and a reduced inner diameter section between the first wide inner diameter section and the second wide inner diameter section. The plunger has a wide diameter section and a narrow diameter section positioned below the wide diameter section. The pilot has a head with a stem extending downwardly therefrom. The pilot has an interior passageway extending therethrough. The plunger is movable within the barrel between an upper position at an upstroke of the plunger and a lower position at a downstroke of the plunger. The head of the pilot has a diameter greater than a diameter of the seat.

The wide diameter section of the plunger is aligned with the first wide inner diameter section of the barrel so as to define a first annulus therebetween in a position of the plunger adjacent to the upper position. The narrow diameter section of the plunger is aligned with the reduced diameter section of the barrel so as to define a second annulus therebetween in the position adjacent to the upper position of the plunger. The second annulus is in fluid communication with the first annulus in the upper position of the plunger. The second aperture of the plunger communicates with at least one of the first annulus and the second annulus in the position adjacent to the upper position of the plunger such that fluid urges the head of the pilot upwardly so as to displace the traveling valve. The fluid in the barrel flows downwardly through the first aperture of the plunger, around the traveling valve, through the interior passageway of the pilot, and through the channel of the plunger so as to enter a lower portion of the barrel.

When the standing valve is in the open position as the plunger moves from the lower position, the wide diameter section of the plunger bears against the reduced inner diameter section of the barrel and the bottom surface of the traveling valve is seated in the seat when the plunger moves from the downward position upwardly.

In the present invention, the plunger has another wide diameter section and another narrow diameter section positioned below the wide diameter section of the plunger. The wide diameter section of the plunger defines an annulus with the first wide inner diameter section of the barrel when the plunger is at uppermost position. The another narrow diameter section of the plunger defines a second annulus with the first wide inner diameter section and the reduced inner diameter section of the barrel when the plunger is in the uppermost position. The first annulus is in fluid communication with the second annulus so as to flow fluid from above the plunger to below the plunger.

The wide diameter section of the plunger is aligned with the first wide inner diameter section of the barrel so as to define an annulus therebetween when the plunger moves from the upper position downwardly. The second aperture of the plunger communicates with the annulus so that fluid urges against the head of the pilot so that the surface of the traveling valve is unseated from the seat of the plunger when the plunger moves downwardly from the upper position such that the fluid flows from the barrel below the plunger upwardly through the channel of the plunger, through the interior passageway of the pilot, around the traveling valve, outwardly of the first aperture of the plunger, and into the barrel above the plunger.

The head of the pilot has a protrusion extending upwardly therefrom so as to selectively extend through the seat of the plunger so as to bear against the surface of the traveling valve. An optional spring can bear against an upper surface of the traveling valve in the interior of the barrel so as to urge the surface of the traveling valve toward the seat of the plunger. This spring may or may not be necessary since the dynamic effect and fluid load can operate to effectively close the traveling valve. The plunger has a rod affixed thereto or formed therewith at an upper end thereof. The rod is adapted to move the plunger upwardly and downwardly in the barrel. The head of the pilot includes a pair of passageways that extend therethrough and open at or adjacent to a top of the pilot. The pair of passageways communicate with the interior passageway of the pilot.

The present invention is also a pumping system for pumping a fluid from the well. This pumping system includes a reciprocating mechanism located at a surface or a near-surface location, a cable or rod connected to the reciprocating mechanism and adapted to extend through the well, and a fluid pump apparatus adapted to be positioned in the well. The fluid pump apparatus has a barrel, a standing valve positioned at a lower end of the barrel and movable between an open position and a closed position, a plunger reciprocatingly mounted in the barrel, a traveling valve positioned in an interior of the plunger so as to control fluid flow through the plunger, and a pilot slidably positioned in the plunger. The plunger has a first aperture at an upper portion thereof and a second aperture extending through a wall of the plunger so as to open to a channel extending longitudinally through the plunger. The traveling valve is slidably movable within an interior of the plunger. The plunger has seat cooperative with a surface of the traveling valve. The pilot is cooperative with the surface of the traveling valve so as to move the traveling valve relative to the seat. The pilot has an end that is separable from the traveling valve during the reciprocating movement of the plunger. The cable is affixed to the plunger so as to move the plunger in a reciprocating fashion and within the barrel.

The present invention is also a fluid pumping system that includes a well, a reciprocating mechanism located at or adjacent to a top of the well, a connector affixed to the reciprocating mechanism and extending through the well, and a fluid pump apparatus connected to the connector. The fluid pump apparatus is positioned in the well. The fluid pump apparatus includes a barrel, a standing valve positioned at a lower end of the barrel and movable between an open position and a closed position, a plunger reciprocatingly mounted in the barrel, a traveling valve positioned in an interior of the plunger so as to control fluid flow through the plunger, and a pilot slidably positioned in the plunger. The plunger has a first aperture at an upper portion thereof and a second aperture extending through a wall of the plunger so as to open to a channel extending longitudinally through the plunger. The traveling valve is slidably movable within an interior of the plunger. The plunger has a seat cooperative with a surface of the traveling valve. The pilot is cooperative with the surface of the traveling valve so as to move the traveling valve relative to the seat. The pilot has an end that is separable from the traveling valve during the reciprocating movement of the plunger. The connector is connected to the plunger so as to move the plunger in a reciprocating manner within the barrel.

In this embodiment the present invention, the well can include a deviated portion. The connector can either be a rod, a cable, a wire rope, a webbing, or a combination thereof.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
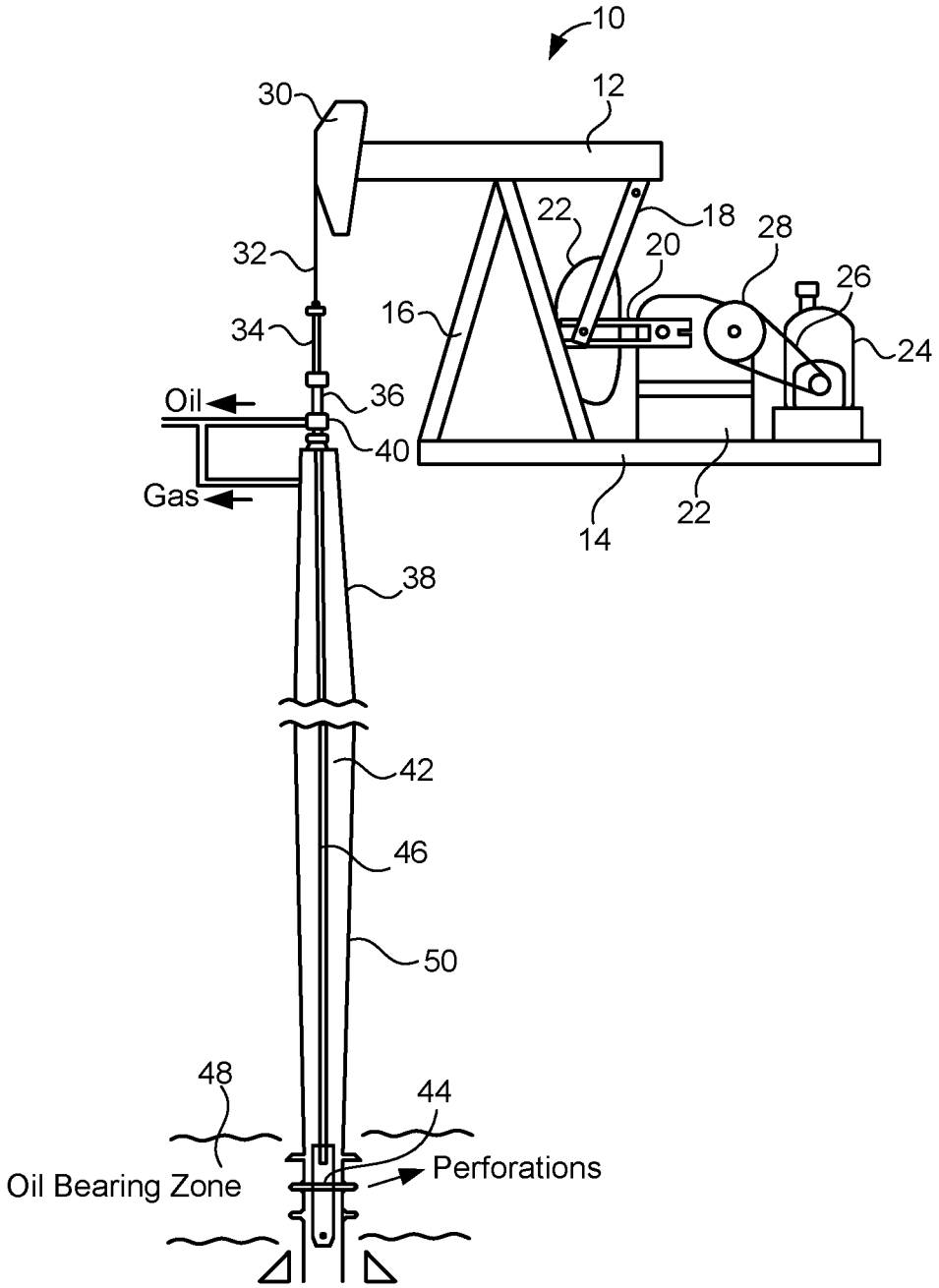
FIG. 1 PRIOR ART
FIG. 1 is a diagrammatic illustration of a conventional rod pumping system of the prior art.

Referring to FIG. 1, there is shown a pumping system 10 in accordance with the prior art. The pumping system 10 is a reciprocating rod-type pumping system. In particular, the pumping system 10 includes a walking beam 12 that is supported above a base 14 by a samson post 16. The walking beam 12 is mounted for pivoting movement with respect to the top of the samson post. A pitman arm 18 is affixed to one end of the walking beam 18 and is engaged with a crank 20. A counterweight 22 is cooperative with the pitman arm 18 and with the end of the walking beam 12. A gear reducer 22 is cooperative with a motor 24. A V-belt 26 extends from a sheave associated with the motor 24 to a sheave 28 associated with the gear reducer 22. The motor 24 will cause a rotation of the sheave so that the V-belt 26 will cause the sheave 28 to rotate. This, in turn, causes a reciprocal movement of the crank 20 and the counterweight 22 so as to cause the walking beam 12 to pivot upwardly and downwardly.

A horsehead 30 is mounted to an opposite end of the walking beam 12. A bridle 32 extends downwardly from the horsehead 30 and is joined to a polished rod 34. Polished rod 34 extends through stuffing box 36 and downwardly into the well 38. There is a tee 40 at the top of the well 38 which allows oil and gas to be transmitted from the interior of the production tubing 42 located within the well 38.

A downhole pump 44 will be located at the end of a sucker rod 46. Sucker rod 46 extends through the interior of the production tubing 42. As a result, the reciprocating movement of the walking beam 12 will cause the sucker rod 46 to move upwardly and downwardly and will cause the downhole pump 44 to move upwardly and downwardly so as to draw fluids through the production tubing 42. It can be seen that the downhole pump 44 is located within an oil-bearing zone 48. Various perforations are formed in the casing 50 in the area of the production zone 48 so as to allow fluids to pass into the casing 50 and around the production tubing 42. Ultimately, the accumulation of fluids within the annulus between the production tubing 46 and the casing 50 will flow so as to be drawn by the downhole pump upwardly for discharge at the surface.

Figure 2:
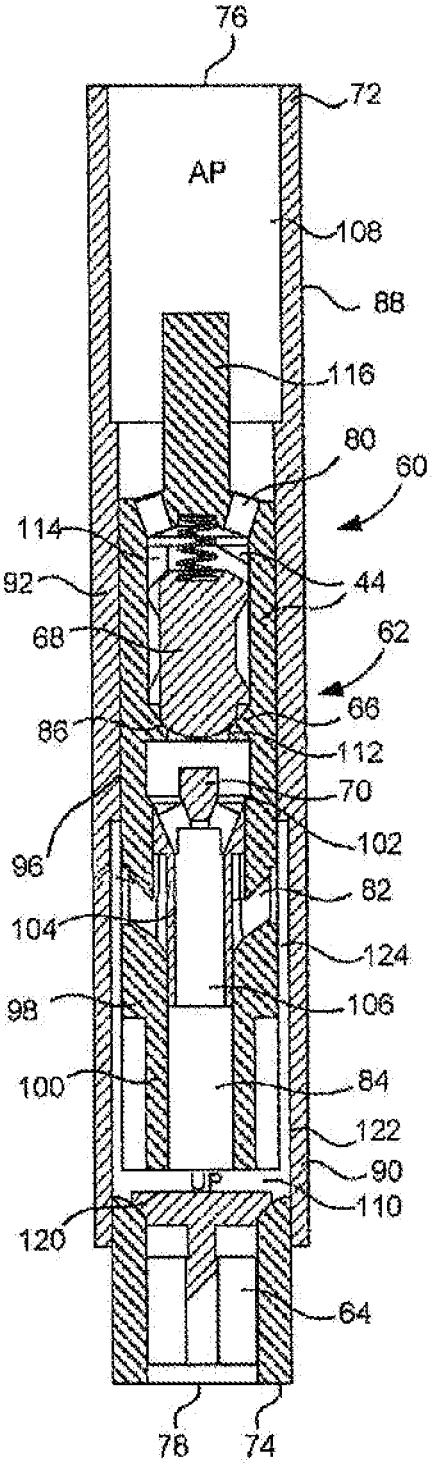
FIG. 2 is a cross-sectional view of the fluid pump apparatus of the present invention with the plunger at the end of the downstroke and the start of the upstroke.

FIG. 2 shows the fluid pump apparatus 60 in accordance with teachings of the present invention. The fluid pump apparatus 60 includes a barrel 62, a standing valve 64, a plunger 66, a traveling valve 68 and a pilot 70. The barrel 62 has an upper end 72 and a lower end 74. The barrel has an opening 76 at the upper end 72 and an opening 78 at the lower end 74. The standing valve is positioned at the lower end 74 of the barrel 62. The standing valve 64 will be movable between an open position and a closed position (as shown in FIG. 2). The plunger 66 is reciprocatingly mounted in the barrel 62. The plunger 66 has a first aperture 80 at an upper portion thereof and a second aperture 82 extending through a wall of the plunger 66 so as to open to a channel 84 extending longitudinally through the plunger 66. The traveling valve 68 is positioned in the interior of the plunger 66 so as to control fluid flow through the plunger 66. The traveling valve 68 is slidably movable within the interior of the plunger 66. The plunger 66 has a seat 86 cooperative with a surface of the traveling valve 68. The pilot 70 is slidably positioned in the plunger 66. The pilot 70 will be cooperative with the surface of the traveling valve 68 so as to move the traveling valve 68 relative to the seat 86. As will be described hereinafter, the pilot 70 has an end that is separable from the traveling valve 68 during the reciprocating movement of the plunger 66.

In FIG. 2, can be seen that the barrel 62 has a first wide inner diameter section 88, a second wide inner diameter section 90, and a reduced inner diameter section 92 located between the first wide inner diameter section 88 and the second wide inner diameter section 90.

The plunger 66 has a wide diameter section 94 and a narrow diameter section 96 located below the wide diameter section 94. The plunger 66 also as another wide diameter section 98 and another narrow diameter section 100. The another narrow diameter section 100 is located below the another wide diameter section 98.

The pilot 70 has a head 102 and a stem 104 extending downwardly from the head 102. The pilot 70 has an interior passageway 106 that extends through the stem 104. The barrel 62 has an above plunger volume 108 and an under plunger volume 110.

In FIG. 2, it can be seen that the traveling valve 68 has a curved bottom surface 112 that is illustrated as received within the seat 86 of the plunger 66. A spring 114 is affixed to the plunger 66 and bears against an upper end of the traveling valve 68 so as to urge the traveling valve 68 toward its seated position. A rod 116 extends upwardly from the top of the plunger 66. Rod 116 allows the plunger 66 to be connected to a connecting rod or a connecting cable (as will be described hereinafter).

FIG. 2 shows the plunger 66 within the barrel 62 at the end of the downstroke and the start of the upstroke. It can be seen that the volume of fluid in the under plunger volume 110 is relatively minimal while the amount of fluid in the above plunger volume 108 is great. The standing valve 64 is illustrated as in its closed position. The standing valve 64 has a flat top surface 120. As such, any contact between the bottom end of the plunger 66 and the flat top surface 120 of the standing valve 64 will not create any damage or destruction of the standing valve 68. The pilot 70 is illustrated as seated on a shoulder. There is an annulus 122 that is formed between the second wide inner diameter section 90 of the barrel 62 and the another narrow diameter section 100 of the plunger 66. There is an annulus 124 formed between the another wide diameter section 98 of the plunger 66 and the inner wall of the second wide diameter section 90 of the barrel 62. The annulus 122 and the annulus 124 facilitate flushing and sand removal from movement the lower plunger area. The upper portion of the plunger 66 is closed but since the first wide diameter section 94 of the plunger 66 bears against the inner wall of the reduced inner diameter section 92 of the barrel 62. As such, the somewhat sealing relationship between the plunger 66 and the barrel 62 will separate the above plunger volume 108 from the under plunger volume 110. At this end/start stroke phase, the traveling valve 68 is closed because of the dynamic effect while the direction of the stroke changes and remains closed because of the load of the fluid column.

Figure 3:
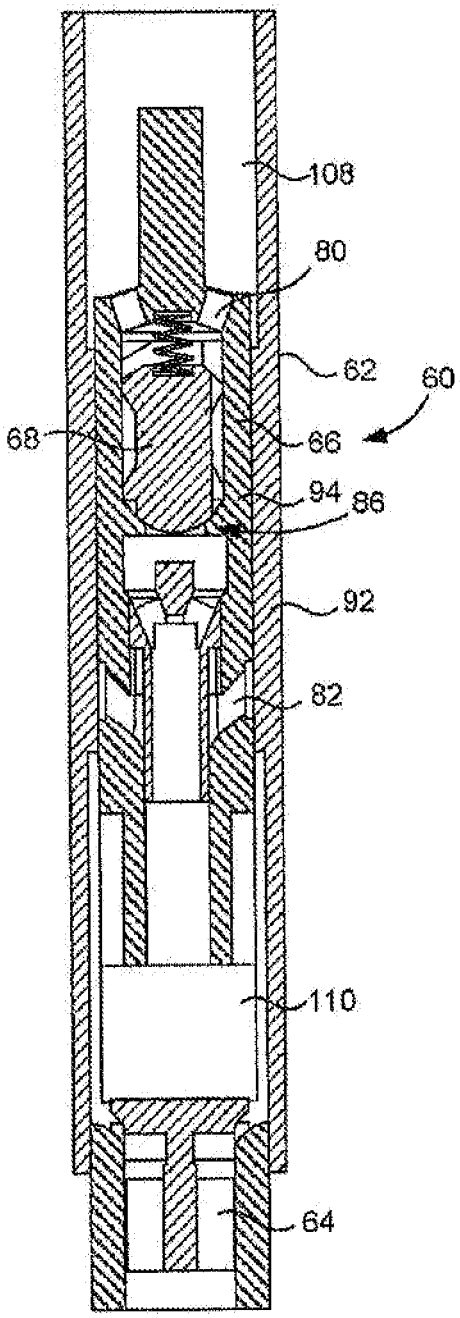
FIG. 3 is a cross-sectional view of the fluid pump apparatus of the present invention with the plunger in an early upstroke position.
Figure 4:
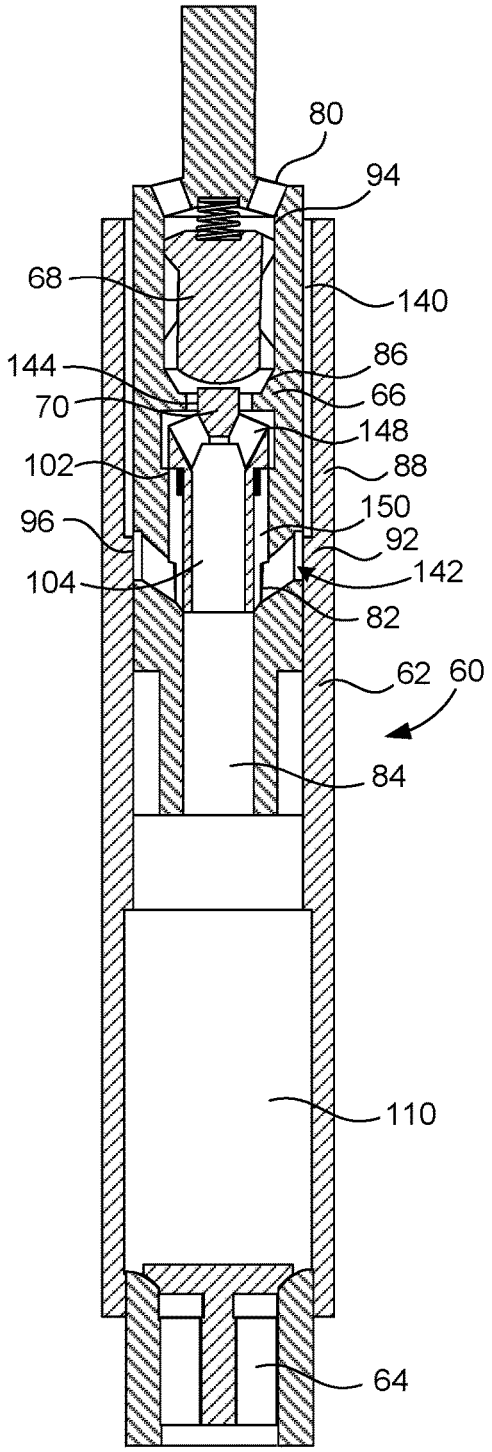
FIG. 4 is a cross-sectional view of the fluid pump apparatus of the present invention showing the plunger in a further upstroke position.

FIG. 3 shows the fluid pump apparatus 60 with the plunger 66 in an initial upstroke position. As the plunger 66 reciprocates upwardly relative to the barrel 62, the under plunger volume 110 will increase as a result of the opening of the standing valve 64. As such, fluid will flow from the opening 78 at the lower end of 74 of the barrel 62 and around the standing valve 64 so as to enter the under plunger volume 110. The standing valve 64 will remain open until the further upstroke position of the plunger 66 (as shown in FIG. 4). The above plunger volume 108 is separated from the under plunger volume 110 by virtue of the seating of the traveling valve 68 on the seat 86. Additionally, the above plunger volume 108 is separated from the under plunger volume 110 by virtue of the close relationship of the wide diameter section 94 of the plunger 66 and the inner wall of the reduced inner diameter section 92 of the barrel 62. The second aperture 82 of the plunger 66 will be blocked from receiving fluid therein. They will also be blocked from receiving fluid therein by virtue of the close relationship of the wide diameter section 94 of the plunger 66 and the reduced inner diameter section 92 of the barrel 62. The traveling valve 68 is closed because the above plunger pressure will be greater than the under plunger pressure. In other words, the fluid within the above plunger volume 108 will enter the interior of the plunger 66 through the first aperture 80 of the plunger 66 and also bear against the traveling valve 68. As such, so as to draw fluid into the under plunger volume 110, the passageways, apertures, and openings in the plunger 66 are effectively sealed by the configuration of components.

FIG. 4 shows the fluid pump apparatus 60 of the present invention with the plunger 66 in a further upstroke position and adjacent to the end of the upstroke. In this configuration, the plunger 66 has entered into the above plunger volume 108. As such, an annulus 140 is defined between the wide diameter section 94 of the plunger 66 and the first wide inner diameter section 88 of the barrel 62. A second annulus 142 will be formed between the reduced diameter section 96 of the plunger 66 and a portion of the first wide inner diameter section 88 of the barrel 62 and a portion of the reduced inner diameter section 92. The annulus 140 will communicate with the annulus 142 so that fluid can flow into the aperture 82 of the barrel 66. This will flow upwardly through the interior of the plunger 66 to bear against the head 102 of the pilot 70. This will cause an upward movement of the pilot 70 such that a protrusion 144 at the top of the head 102 of the pilot 70 will bear against the surface of the traveling valve 68 so as to dislodge the traveling valve 68 from its seat 86. This opens the interior of the plunger 66 so that fluid from the above plunger volume 108 can flow through aperture 80 around the exterior of the traveling valve 68, through the seat 86, into the passageway 148 of the pilot 70, and then into the interior passageway 104 of the pilot 70, and then into the longitudinal channel 84 of the plunger 66. Ultimately, fluid will flow into the under plunger volume 110. In this configuration, the standing valve 64 is closed. The chamber 150 between an inner wall of the plunger 66 and the pilot 70 is pressure balanced with the above plunger pressure.

Importantly, the diameter of the head 102 of the pilot 70 has a greater surface area than the area of the seat 86. As such, the pilot 70 will lift the traveling valve 68 so as to operate with dynamic uncovering of the aperture 82 and the seat 86 for sand removal. This facilitates the flushing of the inner wall of the aperture 82 and the outer wall of the plunger 86. Also, and importantly, this configuration assures that the present invention utilizes inertia and the relationship of cross-sectional areas in order to create the flow through the plunger.

In the present invention, the head 102 of the pilot 70 can have a greater surface area in the area of the seat 86. As such, inertia is not involved in this stage. Alternatively, when the head 102 of the pilot 70 has the surface area equal to that of the area of the seat 86, this will mean that inertia is required for the opening of the traveling valve 86. The spring 11 bears against an upper surface of the traveling valve 68 in the interior of the plunger 66. This maintains the traveling valve 68 until the inertia provided by the directional change from upstroke to downstroke creates the necessary force to open the traveling valve 86. As such, the area of the head 102 of the pilot 70 can have different sizes in relation to the area of the seat 86 in accordance with the present invention. The goal of the present invention is to use the inertia from the acceleration of the pilot 102 and the traveling valve 68 provided at the directional change from upstroke to downstroke to create the additional force required to open the traveling valve 68.

The advantage of the use of such inertia guarantees the opening at the very end of the upstroke so as to allow one to maximize the effective stroke. As such, unlike prior art systems which have to compress or squeeze the fluid through the pump, the present invention actually relies on tension in order to "pull" the fluid through the pump. As such, in such a configuration, any gases (up to 100% gas) will flow through the pump apparatus 60 without problems. There is no possibility of fluid pound or gas lock occurring with this configuration of the present invention since the present invention relies upon tension rather than compression of the fluids.

Ultimately, in FIG. 4, the under plunger volume 110 will be filled by the transfer of fluid from the of the above plunger volume 108, regardless of the quantity of gas in the under plunger volume 110.

Figure 5:
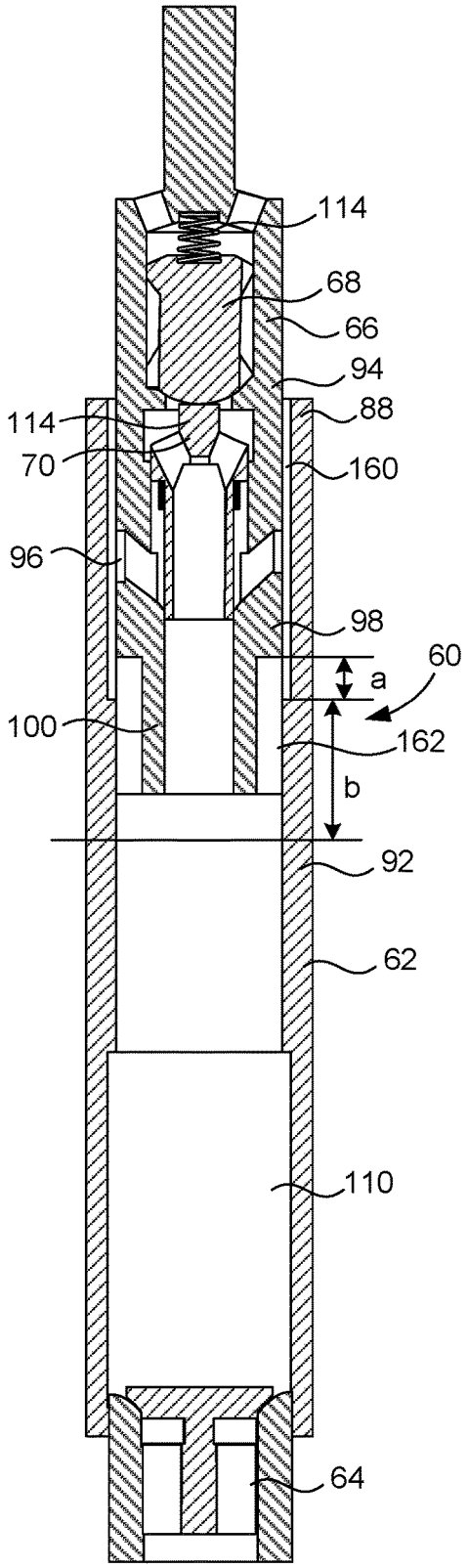
FIG. 5 is a cross-sectional of the fluid pump apparatus the present invention showing the plunger at the end of the upstroke and the start of the downstroke.

Referring to FIG. 5, there is shown the fluid pump apparatus 60 of the present invention with the plunger 66 in the uppermost position in a location above that shown in FIG. 4. In particular, the plunger 66 is at the end of the upstroke and the start of the downstroke. As a result of the momentum of the upward movement of the plunger 66, there is an over-stroke distance a. As a result of this over-stroke distance, a flushing action of the walls of the barrel 62 in the under plunger volume 110 can be accomplished. In particular, an annulus 160 will be formed between the first wide inner diameter section 88 of the barrel 62 and the wide diameter section 94, the narrow diameter section 96 and the another wide diameter section 98 of the plunger 66. Another annulus 162 will be formed between the another narrow diameter section 100 of the plunger 66 and the reduced inner diameter section 92 of the barrel 62. The annulus 160 will communicate with the annulus 162 so that a flow of fluid will move downwardly through the annulus 160, enter the annulus 162 and flow into the under plunger volume 110. Since this occurs during the over-stroke a, this "flushing" action occurs for a very brief period of time and with great force. As such, this will tend to flush any sand, particles or debris from the inner walls of the barrel 92 in the under plunger volume 110. This flushing stroke will occur throughout the distance a during the downward stroke of the plunger 66 within the barrel 62.

In the configuration shown in FIG. 5, the above plunger volume 108 and the under plunger volume 110 are balanced with the fluid pressure column. The spring 114 will act to move the traveling valve 68 downwardly. However, the protrusion 144 on the pilot 70 will still keep the traveling valve 68 slightly open. The pilot will maintain the opening of the traveling valve 68 by autoregulation until the end of the upstroke of the plunger 66. The standing valve 64 will remain closed during this action.

As stated hereinbefore, with reference to FIG. 5, the traveling valve 68 is open at the end of the upstroke. As such, the pressure of the above plunger volume 108 and the pressure of the under plunger volume 110 are the same (i. e. in equilibrium). This ensures that the load corresponding to the weight of the fluid column is no longer supported by the rod string. As a result, the release of the rod elongation is certain during each downstroke. This prevents any risk that the plunger 66 will hit the standing valve 64 at the end of the downstroke. As such, the present invention avoids these potentially damaging circumstances that can occur with conventional pumps.

Figure 6:
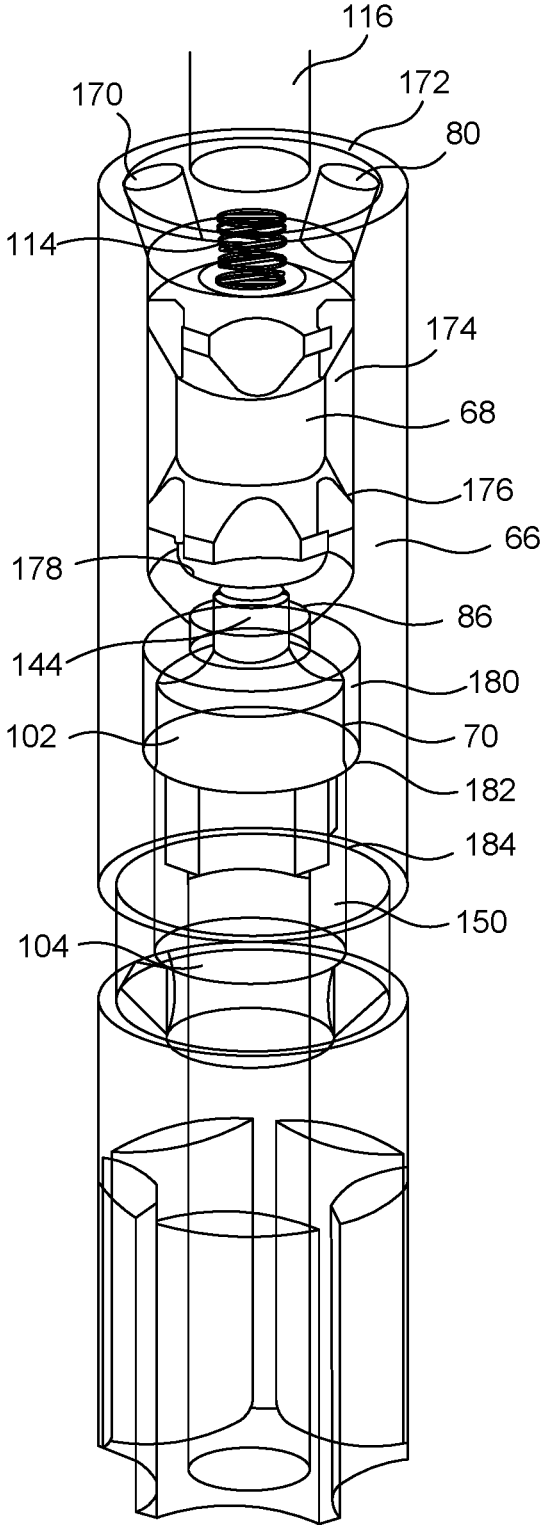
FIG. 6 is a transparent perspective view showing the interior configuration of the plunger of the fluid pump apparatus of the present invention.

FIG. 6 shows, in particular, the interior configuration of the plunger 66. The plunger 66 has a pair of apertures 80 and 170 located at the top 172 of the plunger 66. Rod 116 is affixed to the top 172 of the plunger 66 so as to facilitate manipulation. Apertures 80 and 170 extend at slight angles with respect to each other so as to direct fluid flow either upwardly therethrough or downwardly therefrom. The traveling valve 68 is located within the interior 174 of the barrel 66. Wings 176 slightly bear against the inner wall of the interior 174 so as to properly guide the traveling valve 68. Spring 114 bears of the end surface of the traveling valve 68 so as to generally urge the traveling valve 68 downwardly. The cavities formed between the various wings 176 of the traveling valve 68 allow fluid to flow thereacross. As such, the wings 176 will not present any obstacle to fluid flow. There is a seat 86 formed within the interior 174 of the barrel 66. The bottom 178 of the traveling valve 68 is configured so as to have a surface that properly will seat within the seat 86.

The pilot 70 has a head 102 and a protrusion 144 extending upwardly from the head 102. The protrusion 144 is in the nature of a small rod having a diameter less than the diameter of the opening of the seat 86. As such, the protrusion 144, when moved upwardly, will overcome the force of the spring 114 (and the hydraulic force behind the traveling valve 68 from the fluid column load) to unseat the surface of the traveling valve 68 from the seat 86. A chamber 180 formed on the interior of the plunger 66 accommodates the head 102 of the pilot 70. This allows the head 102 will have a diameter less than the diameter of the chamber 180 so as to allow fluid flow therearound. A shoulder 182 is formed within the interior of the plunger 66 so as to allow the bottom of the head 102 to seat thereagainst. Wings 184 are formed on the pilot 70 so as to allow fluid flow therearound. The stem 104 extends downwardly from the head 102. The chamber 150 is defined between the exterior of the stem 104 and the interior of the plunger 66.

Figure 7:
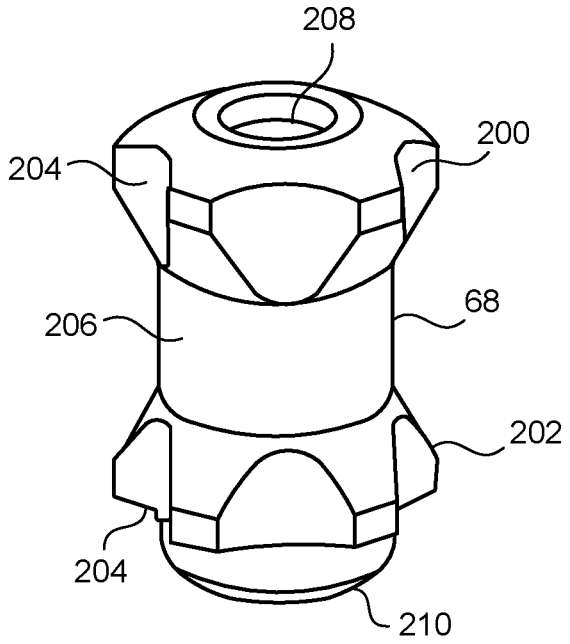
FIG. 7 is an upper perspective view of the traveling valve as used in the fluid pump apparatus of the present invention.

FIG. 7 shows, in particular, the configuration of the traveling valve 68. Traveling valve 68 has a first set of wings 200 at an upper end thereof and a second set of wings 202 at a lower end thereof. The first set of wings 200 is spaced away from the second set of wings. Each of the first set of wings 200 and the second set of wings 202 defines a cavity 204 between adjacent wings so as to allow fluid flow thereacross. Fluid can also flow across the central portion 206. A cavity 208 is formed at the top of the traveling valve 68 so as to accommodate the end of the spring 114. The bottom end 210 of the traveling valve 68 is rounded so as to conform to the shape of the seat 86.

Figure 8:
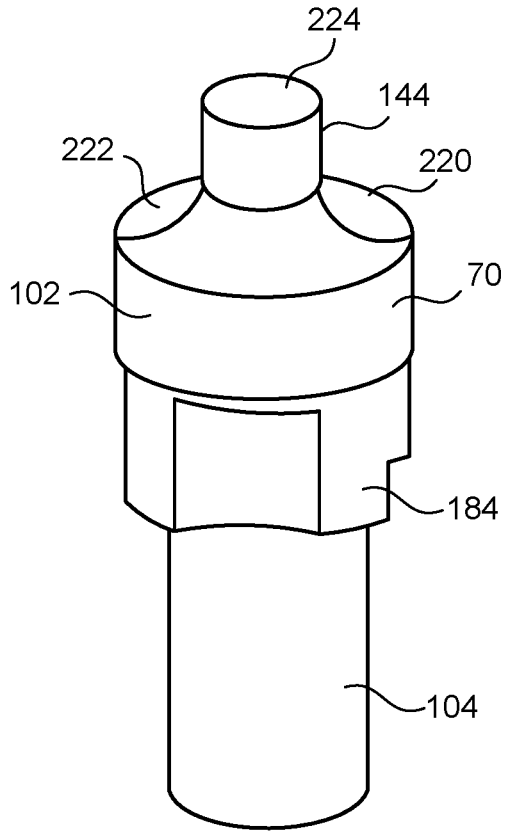
FIG. 8 is an upper perspective view of the pilot as used in the fluid pump apparatus of the present invention.

FIG. 8 shows the pilot 70. Pilot 70 includes a pair of apertures 220 and 222 located at the upper end of the head 102. As such, this will allow fluid flow therethrough and into the interior passageway of the stem 104. Wings 184 define channels across which water can flow. The protrusion 144 is located at the top of the head 102 and between the passages 220 and 222. The protrusion 144 has a flat upper surface 224 which serves to contact the bottom surface of the traveling valve 68 in the manner described herein previously.

Figure 9:
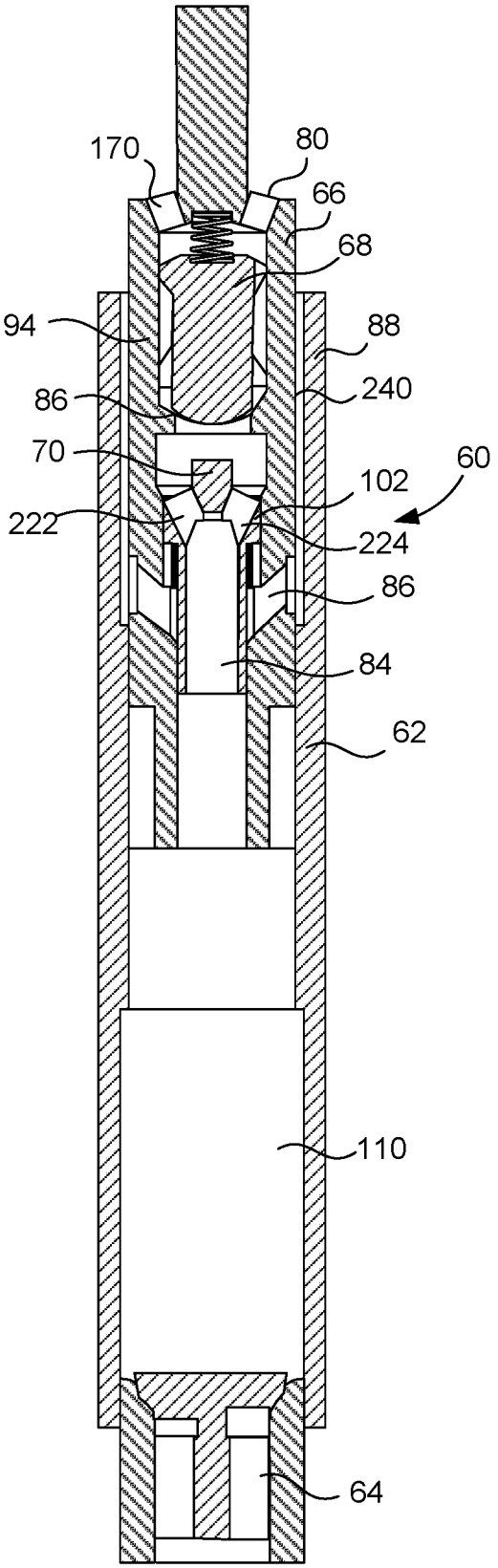
FIG. 9 is a cross-sectional view of the fluid pump apparatus of the present invention with the plunger into an initial downstroke position.

FIG. 9 shows the fluid pump apparatus 60 of the present invention at a first stage of a downstroke of the plunger 66 in the barrel 62. In this configuration, the traveling valve 68 is open. The pilot 70 is in a fully balanced configuration with respect to the above plunger volume 108. This is because the pressure of the fluid that is in the annulus 240 between the first wide inner diameter section 88 of the barrel 62 and the wide diameter section 94 will act through aperture 82 upon the head 102 of the pilot 70 at the same time that pressure bears on the traveling valve 68 through the apertures 80 and 170 at the top of the plunger 66. Although the pilot 70 is fully balanced, it will tend to go downwardly as a result of gravity. Generally, the pilot 70 will be maintained against the traveling valve 68 depending upon the upward force provided by the flow through apertures 222 and 224 if a longer flushing time is required. Proper dimensioning of the apertures can also achieve a longer or shorter flushing time. The standing valve 64 remains closed. Fluid will flow through the traveling valve 68 by transfer from the under plunger area 110 through the longitudinal channel 84, through the interior passageway 104, through the apertures 222 and 224, through the opening between the surface of the traveling valve 68 and the seat 86, around the traveling valve 68, and outwardly of the apertures 80 and 170 and into the above plunger volume 108. The flow from the under plunger to the upper plunger and the flow through the pilot 70 can maintain the opening of the traveling valve 68 depending upon the particular dimensional choices and configurations for the apertures 222 and 224.

Figure 10:
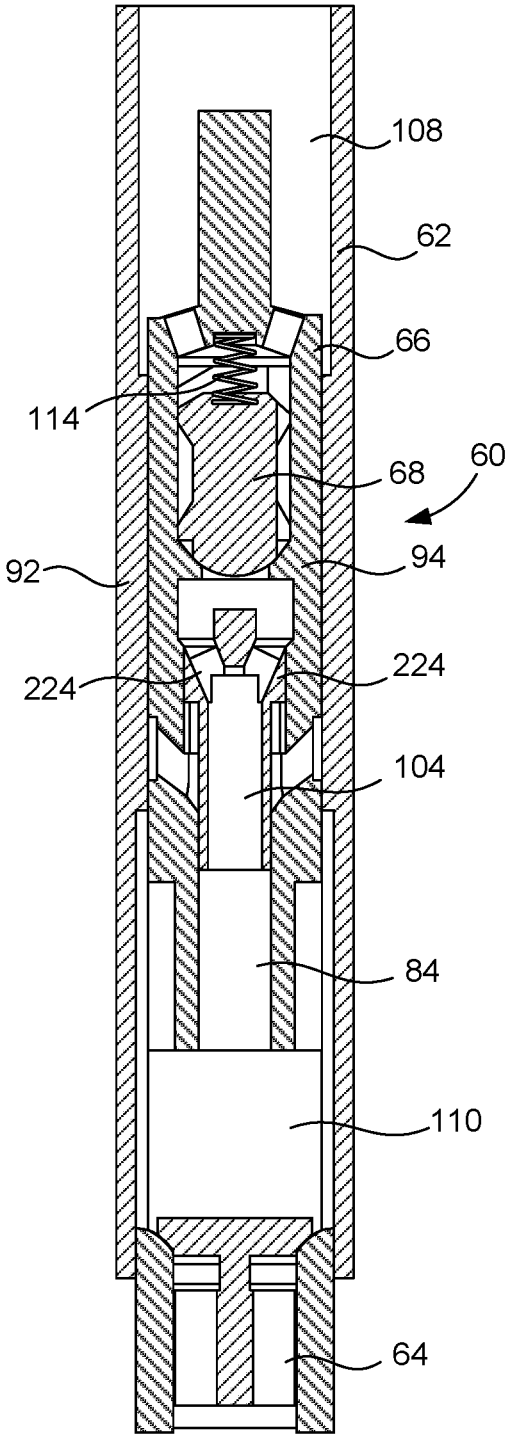
FIG. 10 is a cross-sectional view of the fluid pump apparatus with the plunger in a further downstroke position.

FIG. 10 shows the fluid pump apparatus 60 of the present invention after a further downward movement of the plunger 66 within the barrel 62. It can be seen that the traveling valve 68 is still open due to the flow of fluid from under plunger to above plunger. The standing valve 64 remains closed.

Figure 11:
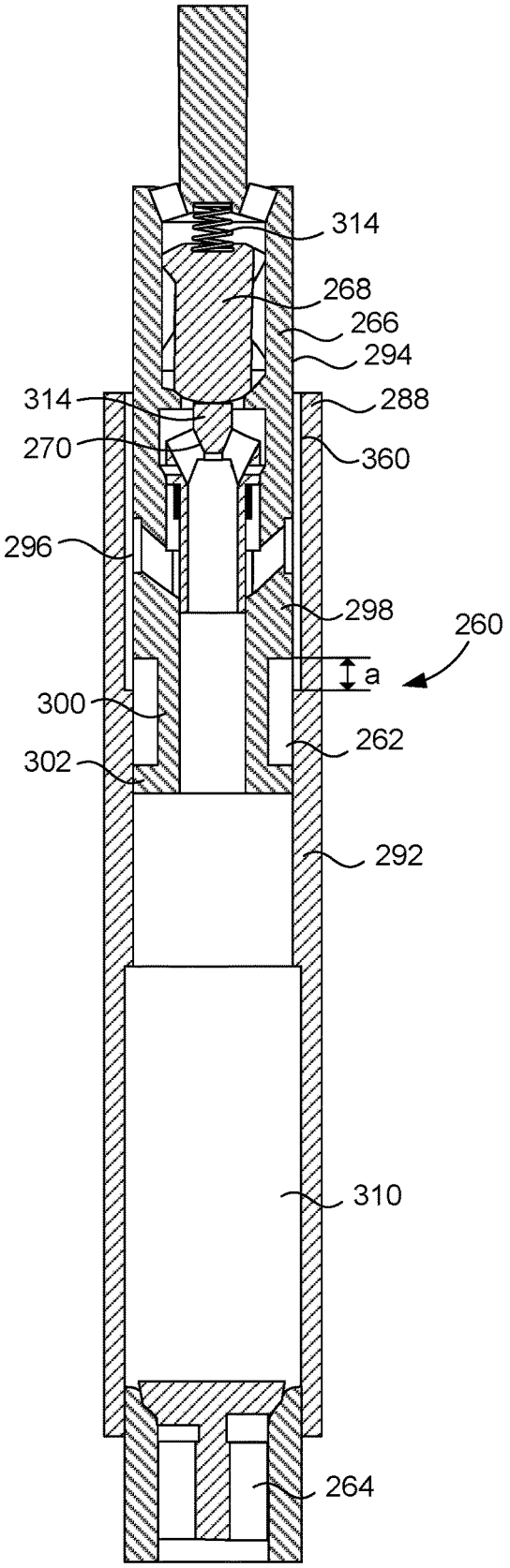
FIG. 11 is a cross-sectional view of the fluid pump apparatus of an alternative embodiment of the present invention showing the plunger at the end of the upstroke and the start of the downstroke.
Figure 12:
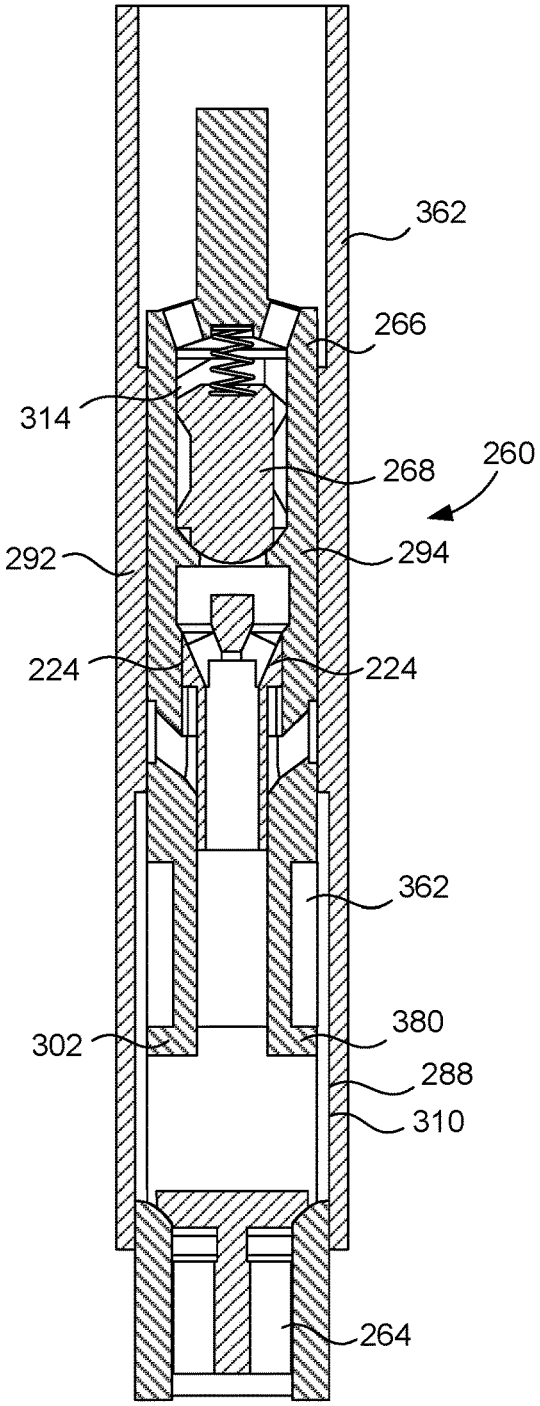
FIG. 12 is a cross-sectional view of the fluid pump apparatus in accordance with an alternative embodiment of the present invention with the plunger in a further downstroke position.

Referring to FIGS. 11 and 12, there is shown an alternative embodiment of the fluid pump apparatus 260 of the present invention. The illustrations of FIGS. 11 and 12 correspond to the FIGS. 5 and 10 of the previous embodiment of the present invention. FIGS. 11 and 12 show this alternative embodiment of the fluid pump apparatus 260 as having a closed slot 362 located at the narrow diameter portion 300 of the plunger 266. Importantly, the bottom of the plunger 266 includes radially outwardly extending portion 302 that bears closely to the reduced inner diameter section 292 of the barrel 262. This closed slot 362 is defined between the another wide diameter section 298 of the plunger 266, the another narrow diameter section 300 of plunger 266 and the radially outwardly extended portion 302. This alternative embodiment of the fluid pump apparatus 260 serves to reduce internal leakage. Any accumulation of debris, particles or sand within this closed slot 362 will move during the downward movement of the stroke of the plunger 266 and will be flushed at the end of the downstroke (as shown in FIG. 12).

Relative to FIG. 11, the fluid pump apparatus 260 is shown with the plunger 266 in the uppermost position. In particular, the plunger 266 is at the end of the upstroke and the start of the downstroke. As a result of the momentum of the upward movement of the plunger 266, there is an over stroke distance a. Unlike the previous embodiment, there will be no flushing action on the walls of the barrel 266 in the under plunger volume 310. The radially outwardly extended portion 302 serves to prevent this flushing action. In FIG. 11, an annulus 360 is formed between the first wide inner diameter section 288 of the barrel 262 and the wide diameter section 294, the narrow diameter section 296 and the another wide diameter section 298 of the plunger 266. The slot 362 is formed between the another narrow diameter section 300 of the plunger 266 and the reduced inner diameter section 292 of the barrel 262. The annulus 360 will communicate with the annulus 362 so that a flow of fluid will move downwardly through the annulus 360 and enter the annulus 362. Further movement of the flow of fluid is prevented by the radially outwardly extended portion 302 of the plunger 266.

In the configuration shown in FIG. 11, the above plunger volume and the under plunger volume 310 are balanced with the fluid pressure column. If used, the spring 314 can act to move the traveling valve 268 downwardly. The protrusion 314 on the pilot 270 will still keep the traveling valve 268 slightly open. The pilot 270 will maintain the opening of the traveling valve 268 by autoregulation until the end of the upstroke of the plunger 266. The standing valve 264 will remain closed during this action.

FIG. 12 shows the fluid pump apparatus 260 in accordance with this alternative embodiment of the present invention after a further downward movement of the plunger 266 within the barrel 262. It can be seen that the traveling valve 268 is still open due to the flow of fluid from the under plunger volume to the above plunger volume. The standing valve 264 remained closed.

Importantly, it can be seen that the slot 362 is moved downwardly so as to create an annulus 380 between the outward end of the radially outwardly extended portion 302 of the plunger 266 and the inner wall of the second wide inner diameter 288 of the barrel 262. As a result, any particles or debris that are accumulated within the slot 362 are released and flushed downwardly through the annulus 380 and into the under plunger volume 310. As can be seen in FIG. 12, this non-opening slot 362 serves to reduce internal leakage between the plunger 266 in the barrel 262.

Figure 13:
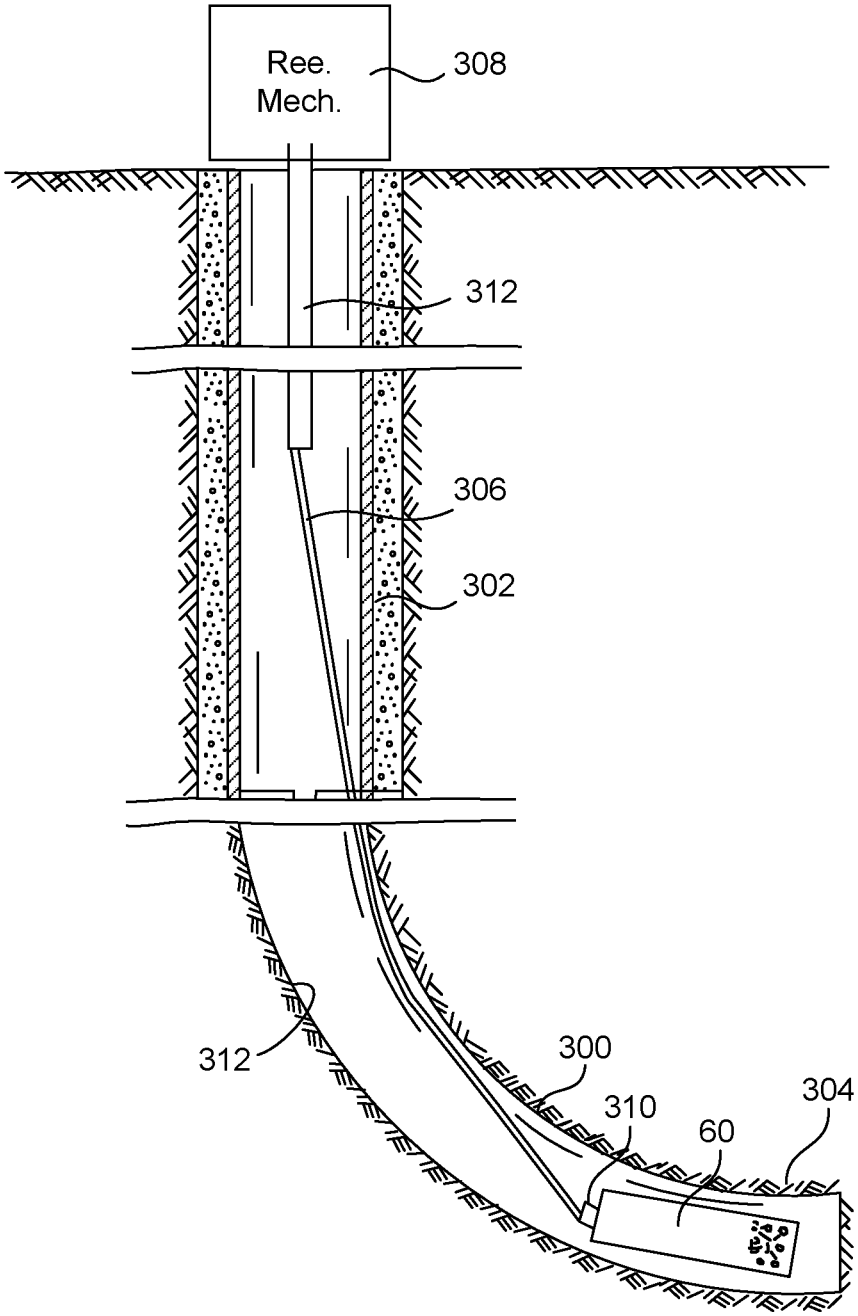
FIG. 13 is an illustration of the use of a wire or cable for controlling the reciprocating motion of the plunger of the fluid pump apparatus of the present invention.

FIG. 13 shows the application of the fluid pump apparatus 60 of the present invention in a well 300. It can be seen that well 300 is a deviated well having a straight section 302 and a curved or deviated section 304. There is a connector 306 that connects a reciprocating mechanism 308 to the plunger 310 of the pumping apparatus 60. The reciprocating mechanism 308 can be a beam pump, a rocking-horse pump, a spool, or a linear hydraulic mechanism. In other words, the rod 312 can be moved upwardly and downwardly for a desired distance so as to properly reciprocate the plunger 310 of the fluid pump apparatus 60.

Importantly, since the present invention draws the fluid upwardly in the well 300 by "tension", as opposed to compression, there is no need for rigid structures to connect the reciprocating mechanism 308 with the plunger 310. The plunger 310 can simply settle downwardly by gravity rather than being forced downwardly. The only action that is necessary is a tension so as to pull the plunger 310 upwardly. This can be achieved with a simple cable, chain, wire, wire rope, webbing, or other type of flexible structure. As a result, very minimal wear occurs with the wall 312 of the pipe within the well 300. In the past, when rigid rods are required (as with compression-type pumps), these rigid rods could wear on the surfaces of the pipe and create damage. This damage would require repair and/or replacement. In order to counter this problem, guides have been placed along such rods so as to protect the surfaces of the pipe from the wearing action caused by the reciprocating movement of such rods. The use of a wire, or other type of flexible connector, will create minimal damage to the surfaces of the pipe since the pressure is not very great. Typically, a flexible line will conform to the interior surfaces of the pipe rather than create friction and strong forces thereagainst. Additionally, the use of a cable or other type of flexible line significantly reduces the cost associated with oil production. Also, unlike prior art systems, very little intervention is required in order to operate the system. Even though the present invention is used in very gassy environments, there is no possibility of a gas lock or a fluid pound.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A fluid pump apparatus for an artificial lift system, the fluid pump apparatus comprising:

a barrel having an upper end and a lower end, said barrel having an opening at said upper end and an opening at said lower end, said barrel having a first wide inner diameter section and a second wide inner diameter section and a reduced inner diameter section between said first wide inner diameter section and said second wide inner diameter section;

a standing valve positioned at said lower end of said barrel, said standing valve movable between an open position and closed position;

a plunger reciprocatingly mounted in said barrel, said plunger having a first aperture at an upper portion thereof and a second aperture extending through a wall of said plunger so as to open to a channel extending through said plunger, said plunger having a wide diameter section and a narrow diameter section positioned below said wide diameter section, said plunger movable within said barrel between an upper position at an upstroke of said plunger and a lower position at a downstroke of said plunger;

a traveling valve positioned in an interior of said plunger so as to control fluid flow through said plunger, said traveling valve slidably movable within an interior of said plunger, said plunger having a seat cooperative with a surface of said traveling valve; and a pilot slidably positioned in said plunger, said pilot being cooperative with the surface of said traveling valve so as to move said traveling valve relative to said seat, said pilot having an end that is separable from said traveling valve during the reciprocating movement of said plunger, said pilot having a head and a stein extending downwardly from said head, said pilot having an interior passageway extending therethrough, said head of said pilot having a surface area greater than a surface area of said seat, said wide diameter section of said plunger aligned with said first wide inner diameter section of said barrel so as to define a first annulus therebetween in a position adjacent to the upper position, said narrow diameter section of said plunger aligned with said reduced inner diameter section of said barrel so as to define a second annulus therebetween in the upper position, said second annulus being in fluid communication with said first annulus in the upper position, said second aperture of said plunger communicating with at least one of said first annulus and said second annulus in the position adjacent to the upper position such that fluid urges said head of said pilot upwardly so as to displace said traveling valve.

2. The fluid pump apparatus of claim 1, wherein fluid in said barrel flows downwardly through said first aperture of said plunger around said traveling valve and through said interior passageway of said pilot and through the channel of said plunger so as to enter a lower portion of said barrel.

3. The fluid pump apparatus of claim 1, wherein said standing valve is in the open position as said plunger moves from the lower position, the wide diameter section of said plunger bearing against the reduced inner diameter section of said barrel and said bottom surface of said traveling valve is seated in said seat when said plunger moves from the lower position upwardly.

4. The fluid pump apparatus of claim 1, the wide diameter section of said plunger aligned with said first wide inner diameter section of said barrel so as to define an annulus therebetween when said plunger moves from the upper position upwardly, said second aperture of said plunger communicating with the annulus so that fluid urges against said head of said pilot so that the surface of the traveling valve is unseated from the seat of the plunger when said plunger moves downwardly from the upper position such that the fluid flows from said barrel below the plunger upwardly through said channel of said plunger and through said interior passageway of said pilot and around said traveling valve and outwardly of said first aperture of said plunger into said barrel above said plunger.

5. The fluid pump apparatus of claim 1, said pilot actuating an opening of said traveling valve before the end of the upstroke of said plunger and before a beginning of the downstroke of said plunger so as to cause a pressure equilibrium above said plunger and under said plunger.

6. The fluid pump apparatus of claim 1, said head of said pilot having said surface area greater than surface area of said seat, the fluid pump apparatus further comprising:

a spring bearing against a surface of said traveling valve in an interior of said plunger, said traveling valve opening at the end of the upstroke of said plunger.

7. The fluid pump apparatus of claim 1, said plunger having a rod affixed or formed at an upper end thereof, said rod adapted to move said plunger reciprocatingly upwardly and downwardly in said barrel.

8. The fluid pump apparatus of claim 1, said head of said pilot having a pair passageways extending therethrough and opening at or adjacent to a top of said pilot, said pair of passageways communicating with said interior passageway of said pilot.

9. The fluid pump apparatus of claim 1, said traveling Valve being open at the end of the upstroke of said plunger such that a pressure above said plunger and a pressure below said plunger are at equilibrium.

10. A fluid pump apparatus for an artificial lift system, the fluid pump apparatus comprising:

a barrel having an upper end and a lower end, said barrel having an opening at said upper end and an opening at said lower end, said barrel having a first wide inner diameter section and a second wide inner diameter section and a reduced inner diameter section between said first wide inner diameter section and said second wide inner diameter section;

a standing valve positioned at said lower end of said barrel, said standing valve movable between an open position and closed position;

a plunger reciprocatingly mounted in said barrel, said plunger having a first aperture at an upper portion thereof and a second aperture extending through a wall of said plunger so as to open to a channel extending through said plunger, said plunger having a wide diameter section and a narrow diameter section positioned below said wide diameter section, said plunger movable within said barrel between an upper position at an upstroke of said plunger and a lower position at a downstroke of said plunger;

a traveling valve positioned in an interior of said plunger so as to control fluid flow through said plunger, said traveling valve slidably movable within an interior of said plunger, said plunger having a seat cooperative with a surface of said traveling valve; and a pilot slidably positioned in said plunger, said pilot being cooperative with the surface of said traveling valve so as to move said traveling valve relative to said seat, said pilot having an end that is separable from said traveling valve during the reciprocating movement of said plunger, said pilot having a head and a stem extending downwardly from said head, said pilot having an interior passageway extending therethrough, said head of said pilot having a surface area greater than a surface area of said seat, said plunger having another wide diameter section and another narrow diameter section positioned below the narrow diameter section of said plunger, the wide diameter section of said plunger defining an annulus with said first wide inner diameter section of said barrel when said plunger is at an uppermost position, said another narrow diameter section of said plunger defining a second annulus with said first wide inner diameter section and said reduced inner diameter section of said barrel when said plunger is in the uppermost position, said first annulus being in fluid communication with said second annulus so as to flow fluid from above said plunger to below said plunger.

11. The fluid pump apparatus of claim 10, said plunger having a radially outwardly extending portion below said another narrow diameter, said plunger movable between the upper position in which the radially outwardly extending portion bears against the reduced inner diameter section of said barrel and the lower position in which the radially outwardly extending portion and the another narrow diameter section define an annulus with the second wide inner diameter of said barrel.

12. A pumping system for pumping a fluid from a well, the pumping system comprising:

a reciprocating mechanism located at a surface location;

a cable connected to the reciprocating mechanism, said cable adapted to extend outwardly through the well; and a fluid pump apparatus adapted to be positioned in the well, the fluid pump apparatus comprising:

a barrel having an upper end and a lower end, said barrel having an opening at said upper end and an opening at said lower end;

a standing valve positioned at said lower end of said barrel, said standing valve movable between an open position and a closed position;

a plunger reciprocatingly mounted in said barrel, said plunger having a first aperture at an upper portion thereof and a second aperture extending through a wall of said plunger so as to open to a channel extending through said plunger;

a traveling valve positioned in an interior of said plunger so as to control fluid flow through said plunger, said traveling valve slidably movable within an interior of said plunger, said plunger having a seat cooperative with a surface of said traveling valve; and a pilot slidably positioned in said plunger, said pilot being cooperative with said surface of said traveling valve so as to move said traveling valve relative to said seat, said pilot having an end that is separable from said traveling valve during the reciprocating movement of said plunger, the cable being affixed to said plunger so as to move the plunger reciprocatingly upwardly and downwardly within said barrel, said barrel having a first wide inner diameter section and a second wide inner diameter section and a reduced inner diameter section between said first wide inner diameter section and said second wide inner diameter section, said plunger having a wide diameter section and a narrow diameter section positioned below said wide diameter section, said pilot having a head and a stem extending downwardly from said head, the wide diameter section of said plunger aligned with said first wide inner diameter section of said barrel so as to define an annulus therebetween when said plunger moves from the upper position upwardly, said second aperture of said plunger communicating with the annulus so that fluid urges against said head of said pilot so that the surface of the traveling valve is unseated from the seat of the plunger when said plunger moves downwardly from the upper position such that the fluid flows from said barrel below the plunger upwardly through said channel of said plunger and through said interior passageway of said pilot and around said traveling valve and outwardly of said first aperture of said plunger into said barrel above said plunger.

* * * * *